US006012627A

United States Patent [19]

Wömpner et al.

[11] Patent Number: 6,012,627

[45] Date of Patent: Jan. 11, 2000

[54] COMPOSITE SECTION HAVING A SUPPORTING BASE OF LIGHT-WEIGHT METAL AND AT LEAST ONE METALLICALLY-JOINED, PROFILED STRIP AND PROCESS FOR MANUFACTURING A COMPOSITE SECTION

[75] Inventors: Diethelm Wömpner, Bodman-Ludwigshafen; Joachim Glück, Schenkenzell; Uwe Bock, Singen, all of Germany

[73] Assignee: Alusuisse Technology & Management Ltd., Switzerland

[21] Appl. No.: 09/071,222

[22] Filed: May 1, 1998

Related U.S. Application Data

[62] Division of application No. 08/872,025, Jun. 10, 1997, Pat. No. 5,918,712, which is a continuation of application No. 08/400,719, Mar. 8, 1995, abandoned.

[30] Foreign Application Priority Data

Mar. 25, 1994 [DE] Germany ..... 44 10 688
Jun. 28, 1994 [DE] Germany ..... 44 22 533

[51] Int. Cl.[7] ..... B23K 31/00

[52] U.S. Cl. ..... 228/265; 228/235.1

[58] Field of Search ..... 228/115, 131, 228/135, 136, 193, 265, 235.1; 72/258, 700; 164/98; 29/DIG. 47

[56] References Cited

U.S. PATENT DOCUMENTS

| | | | |
|---|---|---|---|
| 3,648,343 | 3/1972 | Haller | 419/8 |
| 4,300,379 | 11/1981 | Johnson et al. | 72/258 |
| 4,422,569 | 12/1983 | Payne et al. | 228/173.6 |
| 5,244,746 | 9/1993 | Matsui et al. | 428/609 |

*Primary Examiner*—Samuel M. Heinrich
*Attorney, Agent, or Firm*—Bachman & LaPointe, P.C.

[57] ABSTRACT

A composite section features a base of light-weight metallic material as section component and at least one further profiled section component, in particular a profiled strip of another metallic material which is joined metallically as a surface layer to the base section during an extrusion process. Projecting out of the inner-lying face of the profiled strip and directed at the base is at least one projection and/or an additional element which are/is embedded in the base. Each additional element may delimit an undercut space which is filled in an interlocking manner by metallic material of the base.

7 Claims, 2 Drawing Sheets

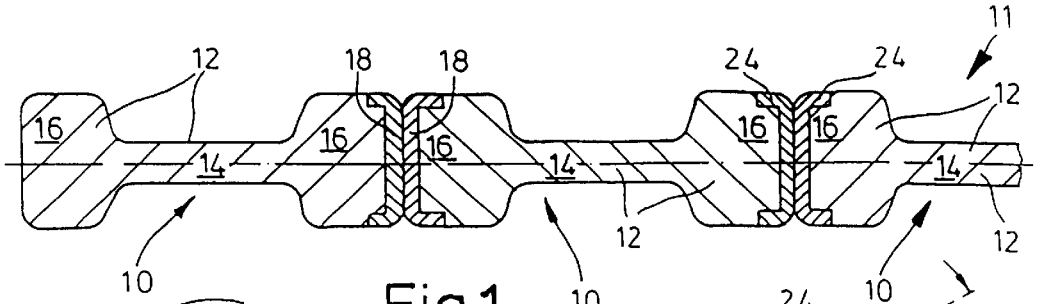
Fig.1
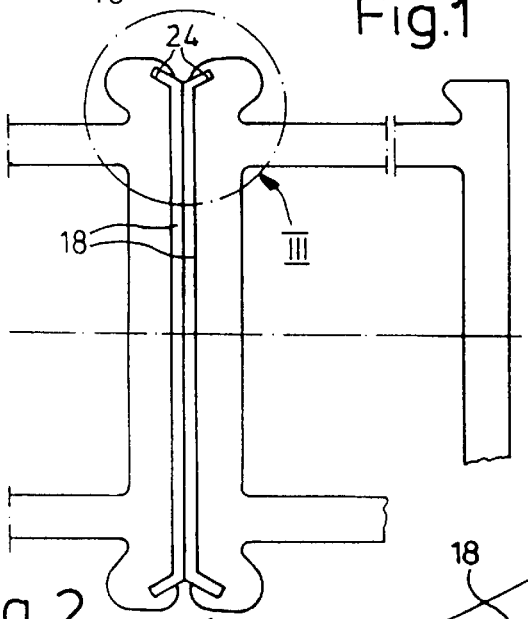
Fig. 2
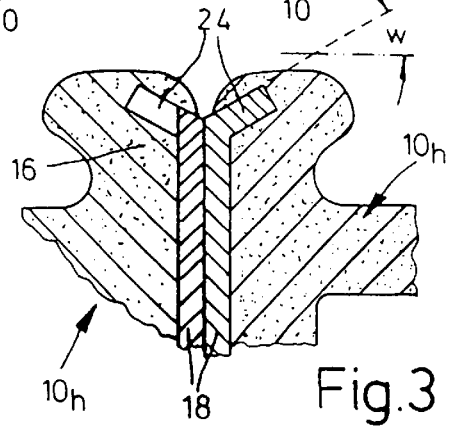
Fig.3
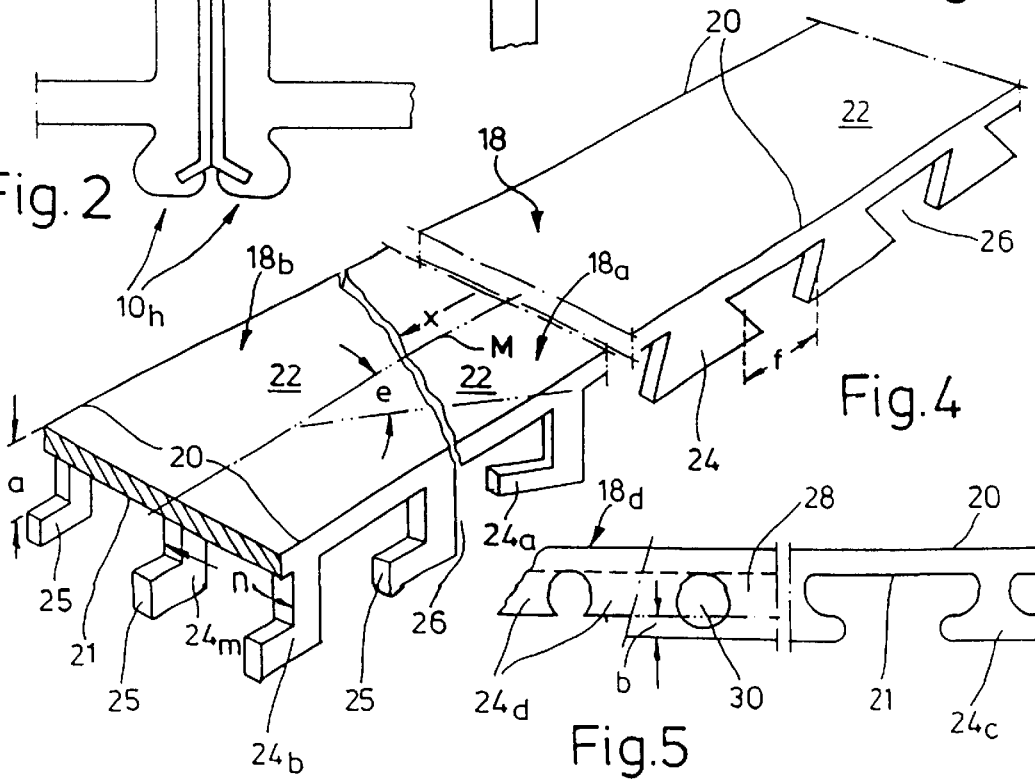
Fig.4
Fig.5

COMPOSITE SECTION HAVING A SUPPORTING BASE OF LIGHT-WEIGHT METAL AND AT LEAST ONE METALLICALLY-JOINED, PROFILED STRIP AND PROCESS FOR MANUFACTURING A COMPOSITE SECTION

This is a Division of application Ser. No. 08/872,025, filed Jun. 10, 1997, which in turn is a Continuation of application Ser. No. 08/400,719, filed Mar. 8. 1995, now abandoned.

BACKGROUND OF THE INVENTION

The invention relates to a composite section having a supporting base of light-weight metal as profiled section component and at least one further profiled section component, in particular a profiled strip of another metal, joined metallically, as a surface layer, to the first mentioned section during an extrusion process. Further, the invention relates to a process for manufacturing a composite section having two profiled components.

Known from the German patent document DE-PS 24 32 541 of the inventor is a process for manufacturing conductor rails having a supporting base section and at least one super-imposed layer of profiled strip of another metal forming at least a part of the surface of the support base. During the extrusion process the support base is created by pressing a billet through the shape-forming cross-section of a die; at the same time the profiled strip runs through the die opening parallel to the longitudinal axis of the die or shape-forming cross-section. The object of the above-mentioned viz., to provide adequate combination of the profiled strip to the support base also when employing non-pre-plated strips and, in addition, to enable particularly economical manufacture is achieved by way of the prior invention in that at least two composite sections are manufactured simultaneously whereby the areas of the support sections to be fitted with the surface layers face each other and the profiled strips, in pairs lying one on top of the other, are introduced through the shape-forming cross-section of the die.

In knowledge of this state of the art the object of the present invention is to improve further the connection between the support section and the profiled strip, at the same time preserving the possibilities for economic manufacture.

SUMMARY OF THE INVENTION

That object is achieved by way of the present invention as described herein.

In accordance with the invention the profiled strip features, at least on one long edge of its inner-lying face directed towards the support section, projections that are spaced apart and project downwards and are embedded in the support base. At the same time the projections should delimit undercut spaces that are filled in an interlocking manner by metallic material from the support base.

Also within the scope of the invention is that at least one additional element is attached to the inner face of the profiled strip and is embedded in the support base; the additional elements should preferably be welded onto the profiled strip and, if desired, delimit an undercut space, that, as mentioned above—is filled in an interlocking manner by metallic material of the base.

On the side of the profiled strip facing the base (joint side), therefore, further sections, strips, transversely stamped sections and strips, bolts or anchor-shaped projections, preferably of stainless steel, are securely joined to the profiled strip by resistance roll seam welding, stud welding or another continuous or spot welding method e.g. non-welded joining such as penetration methods, stamping, indentation-interlocking, or adhesive bonding. As a result, after extrusion the steel strip is joined not only by means of metallic bonding but also by mechanical means due to force and interlocking with the base.

Consequently a permanent joint between the two profiled components is achieved with double security viz., by means of the metallic bond between the light alloy e.g. base section and the profiled strip, and by the interlocking action at the recesses. This form of joining remains intact even if the metallic bond should be incomplete or weakened in some areas.

It has also been found favorable to arrange at least some of the projections at an angle to the longitudinal axis of the profiled strip, preferably inclined inwards in the extrusion direction; this has the effect of intensifying the interlocking action.

According to another feature of the invention, the joint is strengthened by at least one series of projections projecting down from the inner face of the profiled strip between its longitudinal edges at a distance from the same.

Usefully, the projections may be inclined with respect to the inner-lying face of the profiled strip, if desired resulting in two different directions of inclination.

A further version of the invention is such that an additional element is provided on the profiled strip and namely in the form of at least one wire attached to and running parallel to its longitudinal edges, preferably a round wire welded to the central axis of the profiled strip. Or, at least one channel-shaped section is attached to the profiled strip in such a way that its sidewall flanges are directed away from the inner-lying surface of the profiled strip or the underside of the steel strip.

Furthermore, according to the invention these flanges may run at an angle to the inner-lying face, in particular outwards i.e. away from the longitudinal edges of the profiles strip.

It has proved favorable to provide the flanges with recesses, in particular peripheral recesses that are delimited by sections of the flanges.

A further version features an anchorage means in the form of bolts welded to the steel strip.

A process according to the invention for manufacturing the composite section is such that projections projecting out of the plane of the strip-like profiled components are embedded in the light metal matrix and are joined by interlocking with the matrix. The projections projecting out of the plane of the strip-like profiled component(s) are preferably bent out of their plane on entering the die opening.

Of particular importance in this connection is the measure of introducing at least two separate strip-like profiled components, face-to-face one on top of the other, into the die opening, in the process of which the outer facing surfaces of the strip-like profiled components join intimately to the other section components forming the matrix while the other, protected neighboring faces, of the strip-like profiled components remain separate.

A further process according to the invention for manufacturing the composite section is such that additional elements are welded to the strip-like profiled components and the additional elements projecting out of the plane of the strip-like profiled components are embedded and joined in an interlocking manner with it.

In all, the described solution leads to a composite section featuring permanent, intimate bonding of the profiled components and thus to a complete solution of the problem facing the inventor.

Further advantages, features and advantages of the invention are revealed by way of the following description of preferred exemplified embodiments and with the aid of the drawing comprising the following schematic representations:

BRIEF DESCRIPTION OF THE DRAWINGS

FIG. 1: a cross-section through a multi-component composite section;

FIG. 2: a partial end-view of a pair of abutting composite sections each featuring two composite partners;

FIG. 3: an enlarged cross-section through a part of the composite sections in FIG. 2;

FIG. 4: a perspective view of a composite partner of the composite section, showing three different examples thereof;

FIG. 5: a side-view of a component of the composite section, showing two different examples thereof;

DETAILED DESCRIPTION OF PREFERRED EMBODIMENTS

Figure 6:
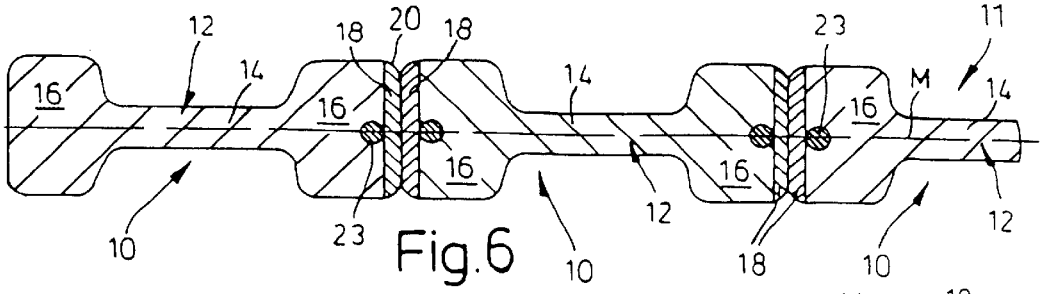
FIG. 6: a cross-section as in FIG. 1 through a further multi-component composite section made up of a plurality of profiled components.
Figure 7:
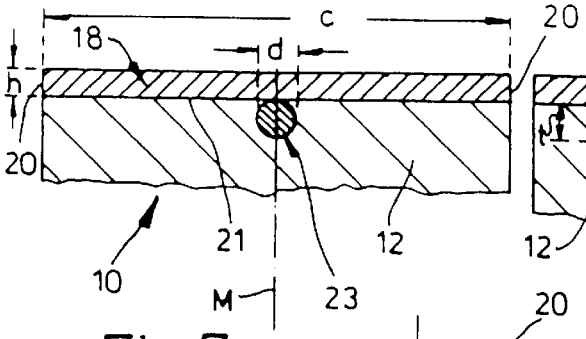
FIG. 7: an enlarged view of part of FIG. 6.

Employing an extrusion press, which for reasons of clarity is not shown in the drawing, a plurality of composite sections 10 is produced as parts of a so called multi-component composite 11, which in one version comprises a rail-like support base 12 with head pieces 16 at both ends of a strut 14 and at least one profiled strip 18 which is joined to one of the head pieces 16 during the extrusion process. The profiled strip 18 is made of iron or non-ferrous metal, the support base of an aluminum alloy.

During the extrusion process the profiled strip 18 is fed into a shape-giving die opening or shaping cross-section of the extrusion press and passes through this together with the matrix material of aluminum alloy flowing from a hot extrusion billet, in the course of that process, and as a result of high pressure, both metallic materials are joined together at the areas of contact. For reasons of economy, and in order to prevent the edges of the essentially ready-shaped profiled strip 18 damaging the shape-giving contour of the extrusion press, the profiled strips 18 of the abutting composites 10 lie one on top of the other.

The harder partner i.e. the profiled strip 18, is provided at its longitudinal edges with pre-shaped projections 24, especially reconizable in FIG. 4, that project down from side of the profiled strip 18 facing the base 12 and are spaced on average a distance f apart, thus delimiting undercut recesses 26.

FIG. 3 shows an enlarged view of the pair of hollow sections $\mathbf{10}_h$ with profiled strip surfacing shown in FIG. 2. From this it can be seen that the projections 24 lie at an angle w outwards and that the projections 24 of both facing strips 18 as seen in end view may be displaced with respect to one another. In a version shown in FIG. 4, middle, the projections $\mathbf{24}_a$ standing at a right angle to the inner face 21 of the profiled strip 18 run at an angle e to the longitudinal axis M of the composite 10.

The inclined or perpendicular position of the projections 24, $\mathbf{24}_a$ is produced either before the profiled strips are introduced into the extrusion press or by means of a bending facility immediately before entering the shape-giving section of the die.

The three versions of profiled strips 18, 18*a* and 18*b* shown in FIG. 4 exhibit at the longitudinal edges 20 either trapezium-shaped projections 24 or hook-like projections $\mathbf{24}_a$, $\mathbf{24}_b$ with hook-ends 25 running a distance a from the section surface 21. One version exhibits a row of projections $\mathbf{24}_m$ on the inner face 21 along the middle axis M of the composite 10 a distance n from the longitudinal edge(s) 20.

FIG. 5 offers T-shaped projections $\mathbf{24}_c$ and $\mathbf{24}_d$ formed by boring openings in the sidewall flanges 28 of a profiled strip 18*d* then removing an edge strip thereof of height b. As a result of the projections 24, $\mathbf{24}_a$ to $\mathbf{24}_d$, other shapes of projections are conceivable, in addition to the metallic bonding between the two components or component partners 12, $\mathbf{1}_h$ and 18, $\mathbf{18}_d$ an interlocking mechanical attachment is achieved during the extrusion process with the support base 12 engaging with these projections 24, 24*a* to 24*d* in the undercut regions, at which stage the aluminum alloy is in a pasty-like condition.

Shown in FIG. 6 is the profiled strip 18 made of a steel strip of width c, or a distance between the longitudinal edges 20 from each other, here 75 mm and a thickness h of 4.5 mm. The strip, prepared in advance, features a round wire or rod 23 of diameter d of approx. 6 mm which has been welded e.g. by resistance welding to the inner face 21 at the middle axis M of the section facing the support base and is embedded in the aluminum alloy matrix forming the support base 12.

Figure 8:
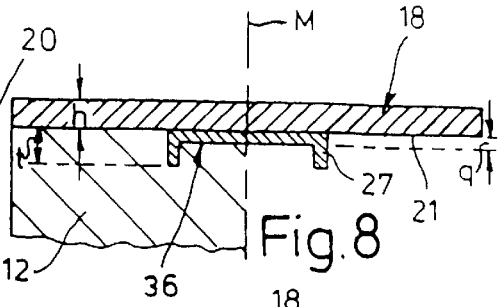
FIGS. 8, 9: another version of that shown in FIG. 7.
Figure 9:
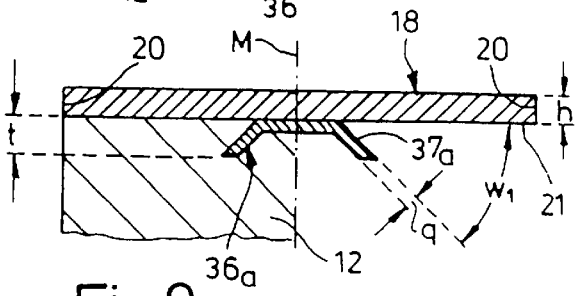

Instead of the round rod 23 the profiled strip 18 in FIGS. 8 and 9 exhibits a channel-shaped section 36, 36*a* made from a steel strip, preferably stainless steel, of thickness q, here 2 mm, that is welded to the inner-face 21. As FIG. 8 shows, at both sides the steel strip features right angled flanges 37 of height t of 6 mm that, in the version $\mathbf{37}_a$ in FIG. 9 are inclined outwards at an angle $w_l$.

Figure 10:
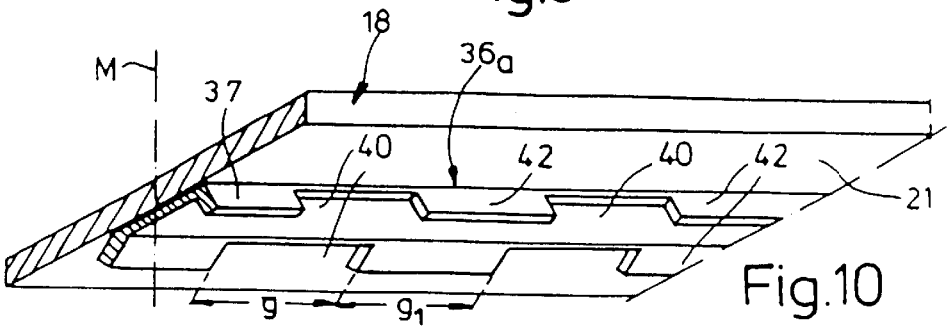
FIG. 10: a perspective view below a version of a profiled component.

Both versions may be employed with channel-shaped sections 36, $\mathbf{36}_a$ having flanges of uniform height t or, as shown in FIG. 10, with recesses 40 of length g in the flanges 37, $\mathbf{37}_a$; the length of remaining turret-shaped flange parts 42 is indicated by $g_l$. Also this transversely stamped channel section 36, $\mathbf{36}_a$ is welded to the steel by resistance roll-seam welding.

Figure 11:
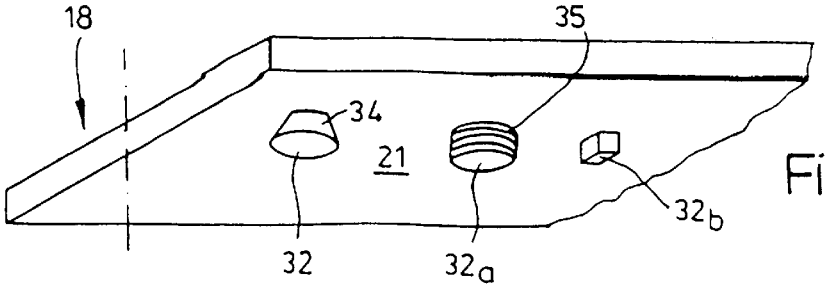
FIG. 11: a perspective view below a further profiled component of the composite section showing three different examples thereof.

FIG. 11 shows bolts 32, $\mathbf{32}_a$, $\mathbf{32}_b$ projecting down from the inner face 21 of the profiled strip 18, said bolts being joined to the profiled strip 18 by stud welding. The left bolt 32, which is the shape of a blunted cone, gives rise to an undercut ring-shaped surface 34. The bolt $\mathbf{32}_a$ in the middle features an external thread 35, bolt $\mathbf{32}_b$ on the right is rectangular in cross-section. These exemplified embodiments of additional elements or bolts 32, $\mathbf{32}_a$, $\mathbf{32}_h$ may be distributed over the inner face 21 as desired.

All of the additional elements 23; 32, $\mathbf{32}_a$, $\mathbf{32}_b$; 36, $\mathbf{36}_a$ described above and shown in FIGS. 6 to 11 are anchored in the light metal matrix of the finished composite section 10. As a result of these elements 23; 32, $\mathbf{32}_a$, $\mathbf{32}_b$; 36, $\mathbf{36}_a$, other shapes of projections are conceivable, a mechanical joint is achieved between the two section components or section partners 12 and 18 during the extrusion process, this in addition to the metallic bonding.

The profiled strips are e.g. uncoiled from two reels and pass from the entrance to the extrusion die or heating facility and brushing station, in which the oxide layer on the profiled strips is removed to ensure metallic bonding. After the actual extrusion process, the profiled strips 18 emerge from the tool with the extruded light weight metal as base 12, whereby, as mentioned, they are embedded in the matrix in such a manner that they do not, or only slightly, come into contact with the tool in the region of the die section.

Even in regions where the metallic bond is absent, e.g. due to residual oxide on the profiled strip 18, $\mathbf{18}_d$, the described mechanical, interlocking action insures good connection between the components.

We claim:

1. Process for manufacturing a composite section out of at least two section components by means of extrusion and by introducing a strip-shaped profiled component during extrusion into the matrix stream, producing a metallic bond between the section components, for production of composite sections, in which process projections spaced apart on the plane of the strip-shaped profiled component are embedded in a light metal matrix and form a joint with the same by means of an interlocking action.

2. Process for manufacturing a composite section out of at least two section components by means of extrusion and by introducing a strip-shaped profiled component during extrusion into the matrix stream, producing a metallic bond between the section components, for production of composite sections, in which process additional elements are welded to the strip-shaped profiled component and the additional elements projecting out of the plane of the strip-shaped profiled component are embedded in and interlock with the light metal matrix.

3. Process according to claim 2, in which, on entering the extrusion die opening, the projections on the strip-shaped profiled component(s) are bent out of the plane of the strip-shape profiled component(s).

4. Process according to claim 1, including introducing at least two separate strip-shaped profiled components, lying face-to-face one on top of the other, into the extrusion die opening or shape-giving cross-section, as a result of which the outward facing surface of strip-shaped profiled components is intimately joined to the other section component forming the matrix at the same time remaining separate from the adjacent strip-like profiled component at the protected superimposed strip surfaces.

5. Process according to claim 2, including introducing at least two separate strip-shaped profiled components, lying face-to-face one on top of the other, into the extrusion die opening or shape-giving cross-section, as a result of which the outward facing surface of strip-shaped profiled components is intimately joined to the other section component forming the matrix at the same time remaining separate from the adjacent strip-like profiled component at the protected superimposed strip surfaces.

6. Process according to claim 3, including the step of producing a composite section which comprises a support base of light-weight metal as profiled section component and at least one further profiled section component joined metallically as a surface layer to the support base section during an extrusion process, wherein the further profiled section includes projections on at least one of its longitudinal edges spaced a distance apart that project down from its inner-lying face directed towards the support base and are embedded in the support base.

7. Process according to claim 2, including the step of producing a composite section which comprises a support base of a light-weight metal as profiled section component and at least one further profiled section component joined metallically as a surface layer to the support base section during extrusion process, wherein the further profiled section includes at least one additional element secured to the face of the further profiled section directed at the support base and embedded in the support base.

* * * * *